US009228784B2

(12) United States Patent
Reif et al.

(10) Patent No.: US 9,228,784 B2
(45) Date of Patent: Jan. 5, 2016

(54) PLATE HEAT EXCHANGER

(75) Inventors: Oscar-Werner Reif, Hannover (DE); Juergen van den Boogaard, Dransfeld (DE); Stefan Weisshaar, Adelebsen (DE)

(73) Assignee: Sartorius Stedim Biotech GmbH (DE)

( * ) Notice: Subject to any disclaimer, the term of this patent is extended or adjusted under 35 U.S.C. 154(b) by 466 days.

(21) Appl. No.: 13/379,387

(22) PCT Filed: Jun. 10, 2010

(86) PCT No.: PCT/EP2010/003490

§ 371 (c)(1),
(2), (4) Date: Dec. 20, 2011

(87) PCT Pub. No.: WO2011/003496

PCT Pub. Date: Jan. 13, 2011

(65) Prior Publication Data

US 2012/0103579 A1 May 3, 2012

(30) Foreign Application Priority Data

Jul. 8, 2009 (DE) ..... 10 2009 032 370

(51) Int. Cl.

| | |
|---|---|
| ***F28D 9/00*** | (2006.01) |
| ***F28F 17/00*** | (2006.01) |
| ***F28F 21/06*** | (2006.01) |

(52) U.S. Cl.

CPC ..... *F28D 9/005* (2013.01); *F28F 17/005* (2013.01); *F28F 21/06* (2013.01); *F28F 2275/02* (2013.01); *F28F 2275/06* (2013.01); *F28F 2280/06* (2013.01)

(58) Field of Classification Search

CPC ..... F28D 9/005; F28F 3/08; F28F 3/086
USPC ..... 165/166, 167
See application file for complete search history.

(56) References Cited

U.S. PATENT DOCUMENTS 3,585,131 A * 6/1971 Esmond ..... B01D 63/14 D63/14
4,630,674 A * 12/1986 Skoog ..... 165/147

(Continued)

FOREIGN PATENT DOCUMENTS

| | | |
|---|---|---|
| DE | 36 41 458 | 6/1988 |
| DE | 197 10 661 | 9/1998 |

(Continued)

OTHER PUBLICATIONS

International Preliminary Report.

*Primary Examiner* — Judy Swann
*Assistant Examiner* — John Higgins
(74) *Attorney, Agent, or Firm* — Gerald E. Hespos; Michael J. Porco; Matthew T. Hespos

(57) ABSTRACT

The invention relates to a plate heat exchanger comprising a plurality of plates having flow channels, wherein a first plate has a front side having at least one flow channel for a first fluid and a second plate has a front side having at least one flow channel for a second fluid, and wherein the plates have through openings via which the flow channels for the same fluid are respectively connected to one another, wherein a front plate, which is placed in front of the front side of the first plate, has ports for the first fluid and for the second fluid, wherein an end plate forms the end of the aligned plates, wherein the plates and ports are formed from plastic, and wherein the plates are bonded or welded tightly together.

17 Claims, 4 Drawing Sheets

(56) References Cited

U.S. PATENT DOCUMENTS

| | | | | |
|---|---|---|---|---|
| 4,744,414 | A * | 5/1988 | Schon | 165/167 |
| 4,852,643 | A * | 8/1989 | Mihailov | 165/113 |
| 4,854,382 | A | 8/1989 | Funke | |
| 5,101,804 | A * | 4/1992 | Cohn | 126/263.01 |
| 5,443,985 | A * | 8/1995 | Lu et al. | 435/393 |
| 5,538,593 | A * | 7/1996 | Sakai et al. | 159/13.1 |
| 5,829,517 | A | 11/1998 | Schmid et al. | |
| 5,961,829 | A * | 10/1999 | Schnorr et al. | 210/603 |
| 6,318,456 | B1 | 11/2001 | Brenner et al. | |
| 6,681,846 | B2 | 1/2004 | Angermann et al. | |
| 6,959,492 | B1 * | 11/2005 | Matsumoto et al. | 29/890.039 |
| 7,637,112 | B2 * | 12/2009 | Vanden Bussche et al. | 62/50.2 |
| 7,981,353 | B2 * | 7/2011 | Mitchell et al. | 264/465 |
| 2004/0156762 | A1 | 8/2004 | Schuppich et al. | |
| 2009/0081075 | A1 * | 3/2009 | Hashiba et al. | 422/24 |
| 2009/0151917 | A1 | 6/2009 | Meschke et al. | |
| 2011/0226603 | A1 | 9/2011 | Peus | |

FOREIGN PATENT DOCUMENTS

| | | |
|---|---|---|
| DE | 199 09 881 | 9/2000 |
| DE | 100 36 602 | 2/2002 |
| DE | 10 2006 013 503 | 1/2008 |
| DE | 10 2008 058 444 | 5/2009 |
| EP | 0 038 454 | 10/1981 |
| EP | 0 203 213 | 12/1986 |
| EP | 0 477 346 | 10/1991 |
| EP | 0 805 328 | 11/1997 |
| EP | 1 308 685 | 5/2003 |
| FR | 2 184 536 | 12/1973 |
| WO | 03100338 | 4/2003 |
| WO | 2008/024066 | 2/2008 |

* cited by examiner

PLATE HEAT EXCHANGER

BACKGROUND OF THE INVENTION

1. Field of the Invention

The invention relates to a plate heat exchanger comprising a plurality of plates having flow channels, wherein a first plate has a front side having at least one flow channel for a first fluid and a second plate has a front side having at least one flow channel for a second fluid, and wherein the plates have through openings via which the flow channels for the same fluid are respectively connected to one another.

2. Description of the Related Art

In pharmacy, biotechnology and in the food industry, gaseous or perhaps liquid mediums frequently have to be heated or cooled. In order to perform such thermal processes, heat exchangers are normally used. Heat is here transported from the warmer medium to the colder medium. The mediums are mutually separated. In this context, there is a need for heat exchangers which are very cheap in terms of material and production.

DE 10 2006 013 503 A1 discloses a plate heat exchanger comprising plates having a plurality of flow channels. A first plate here has at least one flow channel for a first fluid and a second plate here has at least one flow channel for a second fluid. The plates have through openings via which the flow channels for the same fluid are respectively connected to one another.

A drawback in this case is that the plates are mutually sealed in a relatively complex manner by means of seals, or, insofar as they are formed from a ceramic material, it is known to join them integrally in a complex process to form a monolithic block. Both apparatuses which are produced according to this process are correspondingly complex and expensive to make.

From EP 0 038 454 A2, a plate heat exchanger consisting of a multiplicity of extruded individual plates made of polycarbonate is known.

A drawback in this case is that the plates have no internal flow distributor or flow guide. Further complex components for the fluid distribution thus have to be provided. In the course of assembly, difficulties arise in ensuring a leak-tightness necessary for sterile applications.

The object of the present invention is therefore to provide a plate heat exchanger which is of simple and cost-effective configuration in terms of material and production.

SUMMARY OF THE INVENTION

The invention relates to a plate heat exchanger with a first plate having a front side with at least one flow channel for a first fluid and a second plate having a front side with at least one flow channel for a second fluid. The plates have openings via which the flow channels for the same fluid are connected. A front plate, which is placed in front of the front side of the first plate, has ports for the first fluid and for the second fluid, that an end plate forms the end of the aligned plates, that the plates and ports are formed from plastic, and that the plates are bonded or welded tightly together.

The plate heat exchanger according to the invention is of simple construction and can be cost-effectively made by simple production of its plastics plates, for example by injection molding of the plates. Through the bonding together or connection of the plates in a plastic welding process, seals can be dispensed with. The plate heat exchangers can be produced so cheaply that they can be used as disposable heat exchangers. Complex cleaning, or even disassembly, can thereby be dispensed with. By virtue of their construction, the plate heat exchangers according to the invention are suitable for applications from the pharmaceutical, biotechnology and food sectors.

According to a preferred embodiment of the invention, the plates, on their rear sides facing away from the front sides, are configured flat. This has the advantage that the plates can be lined up in any chosen order.

According to a further preferred embodiment of the invention, the plates, on their rear sides facing away from the front sides, have mirror-symmetrical flow channels corresponding to the flow channels of the adjacent front sides.

It is thereby possible, in particular, to configure the first plates and the second plates such that they are structurally identical, wherein the second plates are mounted such that they are turned correspondingly through 180° in relation to the first plates. As a result, only one mold is required for the first and second plates, which makes production considerably simpler.

According to a preferred embodiment of the invention, the flow channels of the plates respectively have flow guides. The flow guides are here configured as barriers or partitions disposed in the flow channels. The partitions of flow channels for the first fluid and of flow channels for the second fluid are preferably arranged perpendicular to each other. This contributes to a better heat exchange.

According to a further preferred embodiment of the invention, the plates have a collecting space. The collecting space is located at the bottom in the vertical direction. Insofar as a gas is conducted through the first flow channel, which gas condenses due to cooling, the condensate collects in the collecting space and is led off via a condensate port in the front plate.

According to a further preferred embodiment of the invention, the plates and ports are formed from a sterilizable plastic. It is thereby possible to supply the plate heat exchanger sterile-packed.

Insofar as the plates and ports are produced from polycarbonate (PC), polyethylene terephthalate (PET), acrylonitrile-butadiene styrene (ABS), polyphenylene ether (PPE) or polyphenylene sulphide (PPS), the plate heat exchangers can be sterilized by irradiation with gamma or beta rays. It is also possible to sterilize the plate heat exchangers by autoclaving with superheated steam.

According to a further preferred embodiment of the invention, the plate heat exchanger is connected to a bioreactor, which preferably is likewise sterilizable.

Thus, for the exhaust gas cooling of a gas to be evacuated from the bioreactor, the port for the entry of the first fluid is connected to an exhaust gas line of the bioreactor and the port for the exit of the first fluid is connectable to an inlet of a sterile filter, whilst the ports for the second fluid can be connected to a cooling circuit.

Liquid vapors which are absorbed when gas is introduced into the bioreactor are condensed and the condensate is fed back to the bioreactor, whereupon the dried exhaust gas can now be evacuated without difficulty via a sterile filter without blocking the latter as a result of condensed liquid.

According to a further preferred embodiment of the invention, for the preheating of a medium which is to be fed to the bioreactor, the port for the entry of the first fluid is connected to a medium supply line for supplying the medium and the port for the exit of the first fluid is connected to an inflow port of the bioreactor, wherein the ports for the second fluid are connected to a temperature control circuit.

In particular, long heating times of the filled bioreactor can thereby be avoided.

Further features of the invention emerge from the following detailed description and the appended drawings, in which preferred embodiments of the invention are illustrated by way of example.

BRIEF DESCRIPTIONS OF THE DRAWINGS

DETAILED DESCRIPTION OF THE PREFERRED EMBODIMENTS

Figure 1:
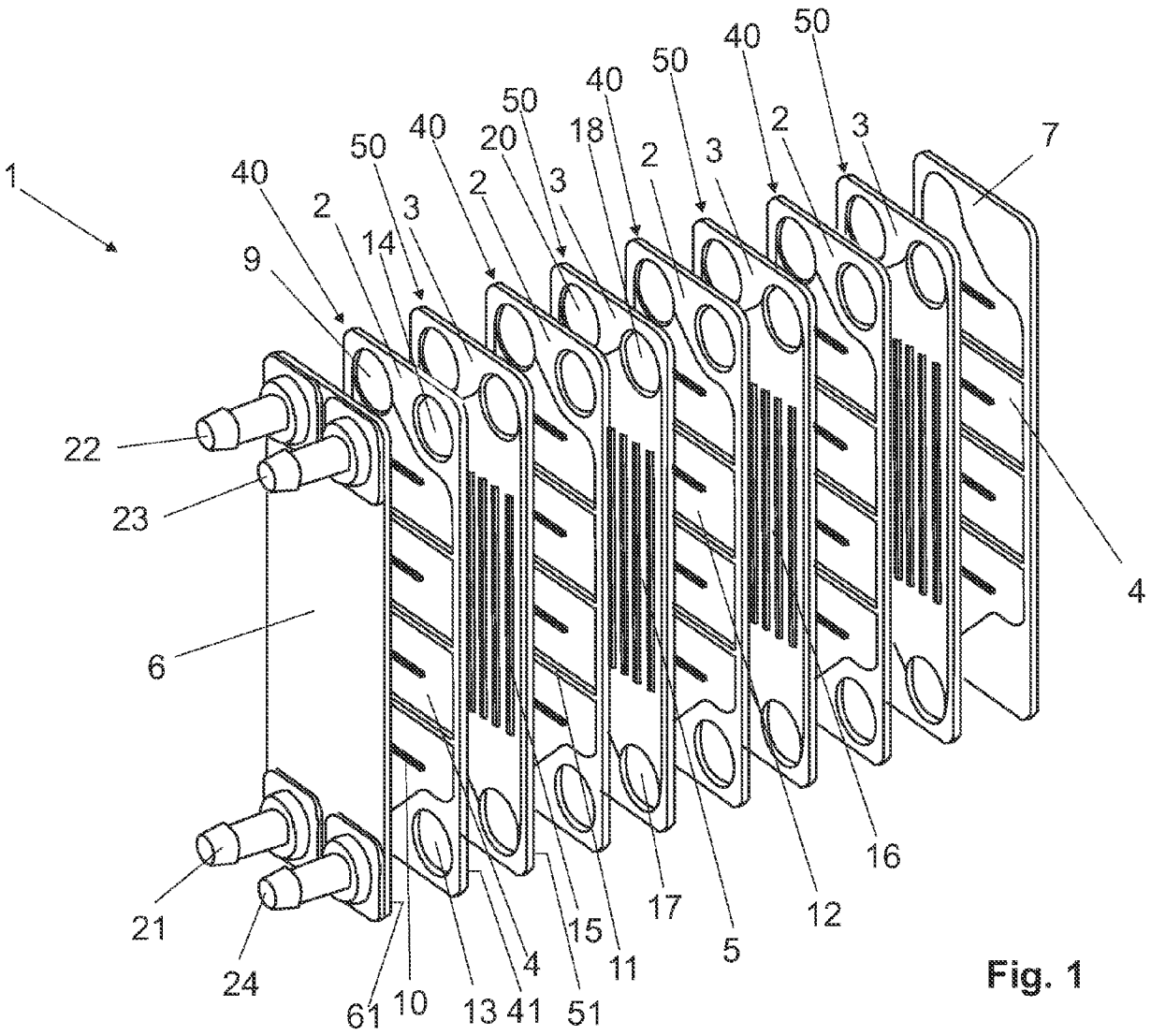
FIG. 1 is an exploded perspective view of a plate heat exchanger.

A plate heat exchanger 1 substantially consists of a plurality of first plates 40 and second plates 50 having flow channels 4, 5, a front plate 6 and an end plate 7.

The first plate 40 has a front side 2 and a rear side 41. In the vertical direction, the first plate 40 has in its corners at bottom left and top left through openings 8, 9 for a first fluid. On the front side 2 of the plate 40 is disposed a planar depression, which forms the flow channel 4 and extends into the through openings 8, 9. In the horizontal direction away from the side walls, the flow channel 4 has flow barriers 10, 11 of a flow guide 12, which overlap in the horizontal direction and thus form a serpentine flow channel 4. The rear side 41 is configured flat, i.e. without a flow channel.

Outside the flow channel 4, the first plate 40 has through openings 13, 14 respectively at top right and bottom right in the vertical direction.

The second plate 50 has on its front side 3 a planar depression, which forms the flow channel 5 and extends into the right-hand through openings 17, 18. The flow channel 5 has vertically running flow barriers 15, which form a flow guide 16. In the left-hand corners, the plate 50 has outside the flow channel 5 through openings 19, 20, which correspond with the through openings 8, 9 of the plate 40. Correspondingly, the through openings 17, 18 of the plate 50 correspond with the through openings 13, 14 of the plate 40. The plate 50 has a rear side 51 facing away from its front side 3, which rear side is configured flat and thus has no flow channel.

The plate heat exchanger 1 has on its front side the front plate 6 having its ports 21, 22 for the first fluid and ports 23, 24 for the second fluid. The port 21 is here connected to the through openings 8, 19 and serves to supply the first fluid, which is evacuated again via the port 22 connected to the through openings 9, 20.

The front plate can optionally have on its rear side (not shown in FIG. 1) a flow channel 4'.

The port 23 is connected to the through openings 14 and 18 and serves to supply the second fluid, whilst the port 24 is connected to the through openings 13 and 17 and is used to lead off the second fluid.

At its end facing away from the front plate 6, the plate heat exchanger 1 is closed off by the end plate 7. The end plate 7 can in this embodiment have a flow channel 4 and in this embodiment has no through openings.

In one embodiment (not represented) of the end plate 7, this is structurally identical to the front plate 6 and is disposed in the plate heat exchanger 1 in mirror symmetry to the front plate 6.

The front side of the end plate can have a flow channel 4, as shown in FIG. 1, but can also be configured flat and thus without a flow channel 4 and can additionally have through openings (not represented), which correspond with the through openings of the plates 40 and 50.

In a particularly preferred embodiment, the front plate 6 and the end plate 7 are respectively provided with through openings in order to enlarge the cross section of the fluid supply without having to change the dimensioning of the ports 21, 22, 23 and 24. In this way, the pressure loss in connection with the inflow and outflow of fluids into and out of the heat exchanger 1 can be minimized particularly advantageously.

As explained above, the plates 40 and 50 are respectively configured flat on their rear sides, whilst the rear side of the front plate 6 and/or the front side of the end plate 7 can be configured plane or can alternatively have a flow channel 4, 4'. The plates 40, 50, 6 and 7 are respectively bonded to the plate situated adjacent thereto.

Figure 2:
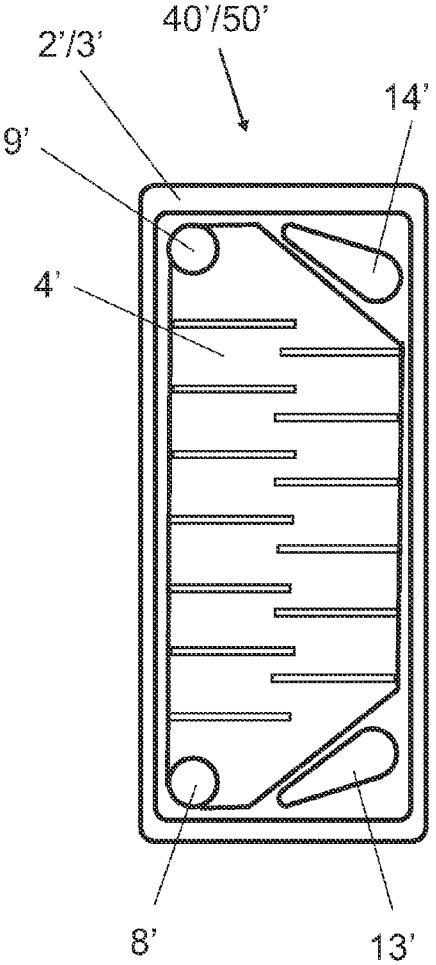
FIG. 2 is a front view of a plate of a plate heat exchanger in a further preferred embodiment, having a flow channel for a first fluid.
Figure 6:
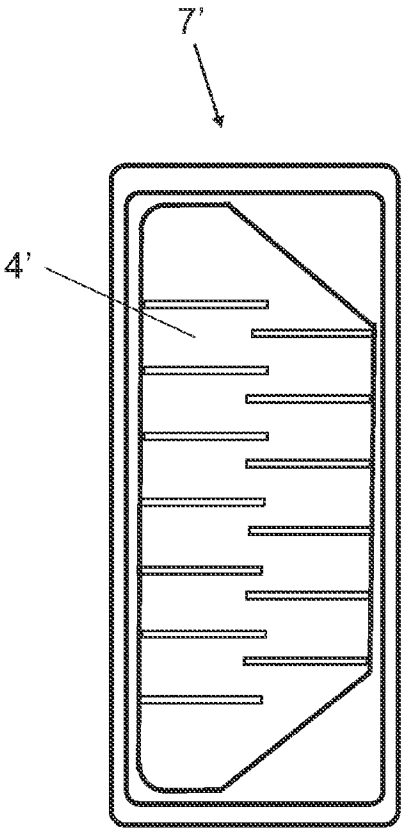
FIG. 6 is a front view of an end plate of a plate heat exchanger having a flow channel for a first fluid.
Figure 5:
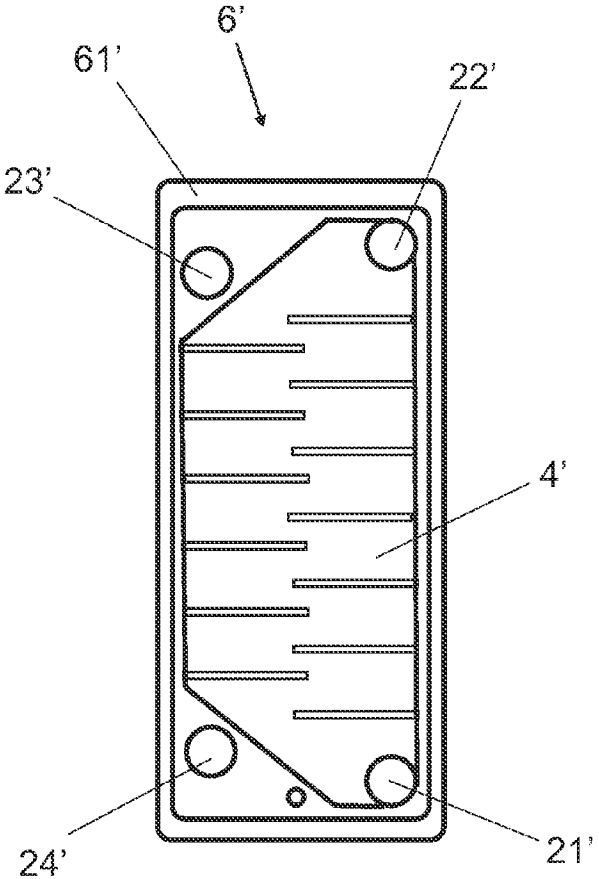
FIG. 5 is a rear view of the front plate of FIG. 4 having a flow channel for a first fluid, which flow channel is configured in mirror symmetry to the flow channel of FIG. 2.

The illustrative embodiment of FIG. 2 shows a plate 40' or 50' having a flow channel 4' on its front side 2' for a first fluid in the form, for instance, of a cooling medium.

In the vertical direction, the first plate 40' or 50' has in its corners at bottom left and top left through openings 8', 9' for the first fluid. On the front side 2' of the plate 40' is disposed the flow channel 4', which is connected to the through openings 8', 9'. Outside the flow channel 4', the side 2' has through openings 13', 14' respectively at top and bottom right in the vertical direction.

Figure 3:
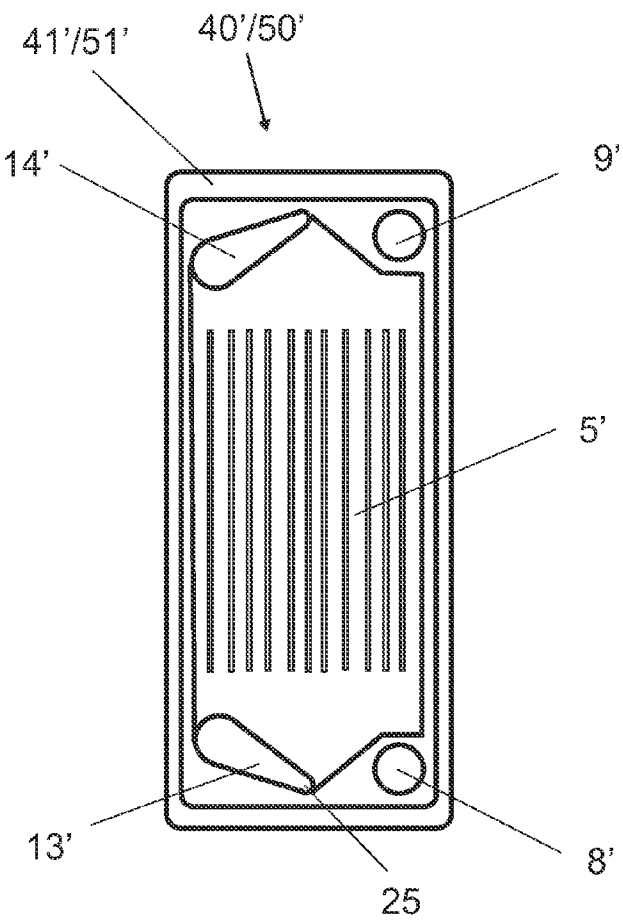
FIG. 3 is a rear view of the plate of FIG. 2.

The rear side 41' of the first plate 40' (see FIG. 3) has a flow channel 5' for a second fluid.

The plate 40' and the plate 50' are exactly structurally identical. Analogously to the plate sequence shown in FIG. 1, the plates 40' and 50' can be put together to form a plate heat exchanger, wherein the plates 50' are mounted such that they are turned correspondingly through 180° in relation to the structurally identical plates 40'. Unlike the embodiment according to FIG. 1, in which the rear sides of the plates 40 and 50 are respectively flat, this assembly produces a plate heat exchanger 1 in which the front and the rear side of the assembled plates 40' and 50' respectively have a flow channel 4' and 5'.

Figure 4:
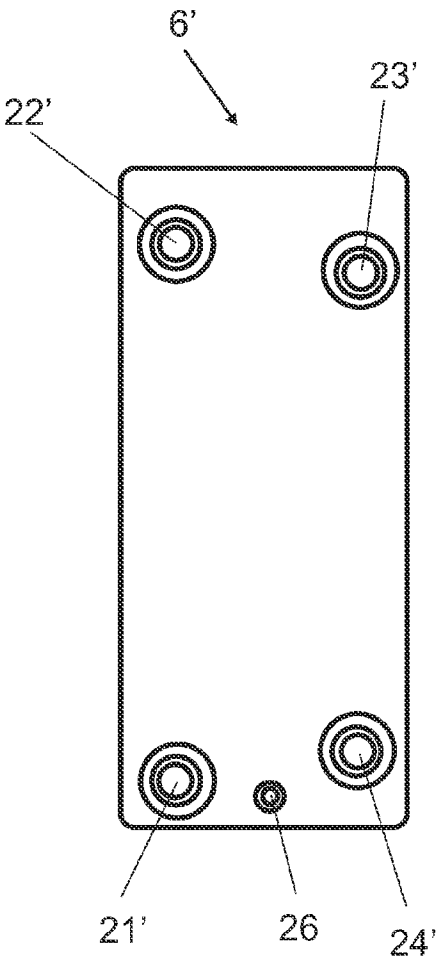
FIG. 4 is a front view of a front plate of a plate heat exchanger having ports for a first fluid, for a second fluid and having a condensate port.

The flow channel 5', in the lower region in the vertical direction, has a collecting space 25, which serves to receive condensate which is evacuated via a condensate port 26 disposed on the front plate 6' (see FIG. 4). The through openings 13' and 14' for the second fluid of the plate 50' are of elongated configuration and correspond with through openings 13', 14' of the plate 40' (see FIG. 2).

The rear side 51' of the plate 50' (see FIG. 3) has a flow channel for a first fluid, which flow channel corresponds to the flow channel 4' of a further, structurally identical plate 40' or to the flow channel 4' of an end plate 7'.

The plate heat exchangers 1, 1' according to the illustrative embodiments of FIGS. 1 to 6 are formed from polycarbonate (PC). They can readily be irradiated with Gamma rays and are suitable for any sterile application in the temperature range up to 110° C., briefly even up to 125° C. The plate heat exchangers 1, 1' can thus also be sterilized with superheated steam.

Figure 7:
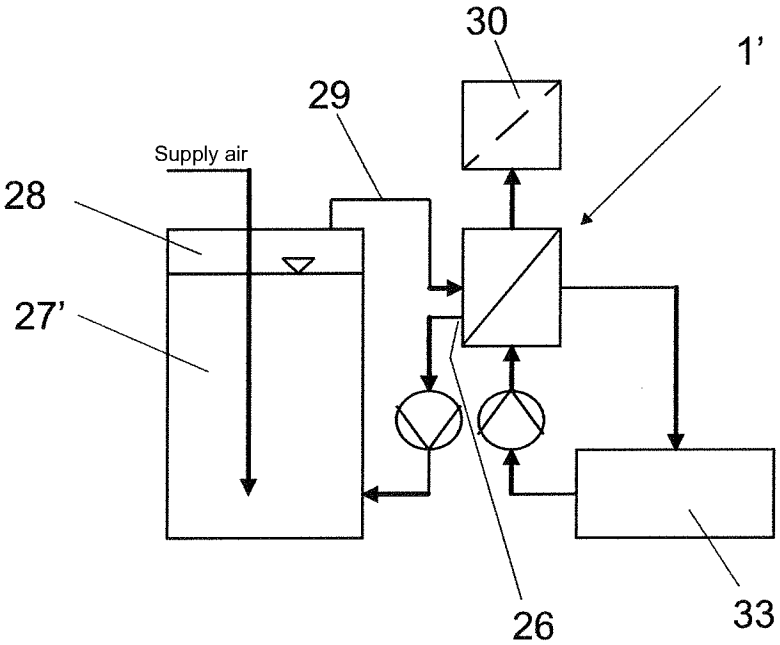
FIG. 7 is a schematic representation of a process diagram of a bioreactor connected to a plate heat exchanger configured as an exhaust gas cooler.

According to the illustrative embodiment of FIG. 7, the plate heat exchanger 1' is connected to a bioreactor 27' and is used as an exhaust gas cooler. The exhaust gas is conducted from the headspace 28 of the bioreactor 27', via an exhaust gas line 29 connected to the port 23' of the plate heat exchanger 1', into the top of the plate heat exchanger 1'. In the plate heat exchanger 1', the gas stream is divided by means of the flow channel 5' over the individual front sides 3' of the plates 50'. On the front sides of the plates 3' of the plates 50', the gas stream is cooled as it flows downward on the plate wall, and is evacuated via the port 24' and further delivered to the environment via a sterile filter 30. As a result of the exhaust gas cooling in the plate heat exchanger 1', the air moisture of the exhaust gas is lowered, whereupon liquid medium accommodated in the bioreactor is condensed, led off via the condensate port 26 and fed back to the bioreactor 27' via a hose pump.

In counterflow thereto, cooling medium is conducted from the primary cooler 33 from below, via the port 21', into the plate heat exchanger 1'. From the through openings 8', the cooling medium is conducted into the individual flow channels 4' and absorbs the heat from the plates 40' and 50'. The cooling medium is hereupon heated. The cooling medium is collected in the through opening 9' and conveyed via the port 22' back into the primary cooler 33. The cooling medium is circulated.

Figure 8:
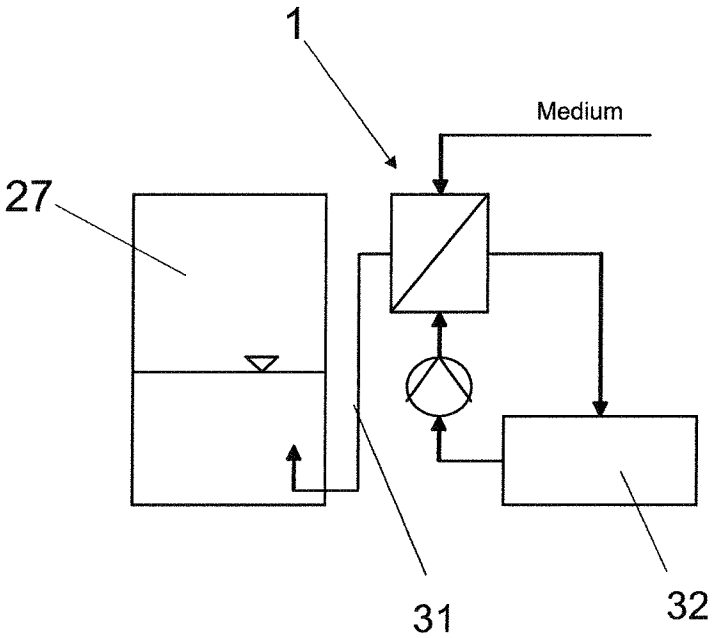
FIG. 8 is a process diagram of a bioreactor connected to a plate heat exchanger as a medium heating apparatus for preheating during filling of the bioreactor.

According to the illustrative embodiment of FIG. 8, the plate heat exchanger 1 is connected to the bioreactor 27 via a supply line 31. The plate heat exchanger 1 is here used to preheat medium which is to be fed to the bioreactor 27.

The medium which is to be heated is conducted from a supply reservoir (not represented) into the plate heat exchanger 1 from above, via the port 23. In the plate heat exchanger 1, the material stream is distributed, by means of the flow distributor derived from the through openings 14 and 18, into the individual channels 5. In the flow guides 12, the medium current is heated as it flows downward on the plate wall. The medium currents are combined and conducted to the outlet or port 24. From the port 24, the preheated medium is conveyed into the bioreactor 27.

In counterflow thereto, heating medium is conducted from a thermostat 32 from below, via the port 21, into the plate heat exchanger 1. In the flow distributor derived from the through openings 8 and 9, the heating medium is conducted into the individual channels 4 and delivers the heat to the plates 40 and 50. The heating medium is conveyed from the outlet or from the port 22 back into the thermostat 32. The heating medium is circulated.

The invention claimed is:

1. A plate heat exchanger (1, 1') comprising:

at least one first plate (40, 40') having a front surface (2, 2') with a depression defining a first flow channel (4, 4') for a first fluid and a rear surface opposite the front surface, first flow guides (12) in the depression and aligned in a first direction, the first plate (40, 40') further having a first inlet through opening (8, 8') and a first outlet through opening (9, 9') at substantially opposite ends of the first flow channel (4, 4') for accommodating an inflow of the first fluid into the first flow channel (4, 4') and an outflow of the first fluid from the first flow channel (4, 4'), the first plate (40, 40') further having two first openings (13, 13', 14, 14') outward of the first flow channel (4, 4');

at least one second plate (50, 50') having a front surface (3, 3') with a depression defining a second flow channel (5, 5') for a second fluid and a rear surface opposite the front surface thereof, second flow guides (16) in the depression and aligned in a second direction transverse to the first direction, areas of the front surface of the second plate (50, 50') outward of the second flow channel (5, 5') being in direct contact with the rear surface of the first plate (40, 40'), the second plates (40, 40', 50, 50') having a second inlet through opening (18, 14') and a second outlet through opening (8, 8', 9, 9', 13, 17, 18, 13', 141, 14', 19, 20) for accommodating an inflow of the second fluid into the second flow channels (4, 4', 5, 5') and an outflow of the second fluid from the second flow channel, the second inlet and outlet openings (17, 18, 13', 214') communicating with the first openings (13, 13', 14, 14') of the first plate (40, 40'), the second plate (50, 50') further having two second openings outward of the second flow channel (5, 5') and communicating with the first inlet and outlet through openings (8, 8', 9, 9'), a front plate (6, 6') placed in front of the front surface (2, 2') of the first plate (40, 40') and having two first ports (21, 21', 22, 22', 23, 23', 24, 24') for the first fluid and two second ports (23, 23', 24, 24') for the second fluid, areas of the front surface of the first plate (50, 50') outward of the first flow channel (5, 5') being in direct contact with the front plate (6, 6'), an end plate (7, 7') forming an end of the plates (40, 40', 50, 50', 6, 6') and being in direct contact with the rear surface of the second plate (50, 50'), the plates (40, 40', 50, 50', 6, 6', 7, 7') and ports (21, 21', 22, 22', 23, 23', 24, 24') being formed from plastic, the plates (40, 40', 50, 50', 6, 6', 7, 7') being bonded or welded in direct contact with one another so that the respective flow channels have fluid tight seals, and the second flow channel (5'), in a lower region in a vertical direction, having a collecting space (25) to receive condensate of the second fluid that can be evacuated via a condensate port (26) spaced from the second ports (23, 23', 24, 24'), wherein the collecting space (25) is connected with the second outlet through opening (8, 8', 9, 9', 13, 17, 18, 13', 141, 14', 19, 20) to define an elongated through opening having in the vertical direction a lower region aligned with the condensate port (26) and an upper region aligned with one of the second ports (23, 23', 24, 24').

2. The plate heat exchanger of claim 1, wherein the rear surface of the front plate (6, 6') has a flow channel (4, 4').

3. The plate heat exchanger of claim 1, wherein the front surface of the end plate (7, 7') has a flow channel (4, 4').

4. The plate heat exchanger of claim 1, wherein the rear surface (61, 61') of the front plate (6, 6') is flat.

5. The plate heat exchanger of claim 1, wherein a front surface of the end plate (7, 7') is flat.

6. The plate heat exchanger of claim 1, wherein the rear surfaces (41, 51) of the first and second plates (40, 50) are flat.

7. The plate heat exchanger of claim 1, wherein the rear surface (41', 51', 61') of each of the first and second plates (40', 50', 6', 7') has a flow channel with an outer boundary that is mirror-symmetrical with the flow channel (4', 5') on the corresponding front surface (2', 3') thereof.

8. The plate heat exchanger of claim 7, wherein the first plates (40') and the second plates (50') are configured structurally identical and the second plates (50') are mounted such that they are turned correspondingly through 180° in relation to the first plates (40').

9. The plate heat exchanger of claim 1, wherein the plates (40, 40', 50, 50', 6, 6', 7, 7') and ports (21, 21', 22, 22', 23, 23', 24, 24', 26) are formed from a sterilizable plastic.

10. The plate heat exchanger of claim 9, wherein the plates (40, 40', 50, 50', 6, 6', 7, 7') and ports (21, 21', 22, 22', 23, 23', 24, 24', 26) are produced from PC, PET, ABS, PPE or PPS.

11. The plate heat exchanger of claim 10, wherein the plates (40, 40', 50, 50', 6, 6', 7, 7') and ports (21, 21', 22, 22', 23, 23', 24, 24', 26) are formed from a material that can be irradiated with gamma and/or beta rays or can be autoclaved with superheated steam.

12. The plate heat exchanger of claim 1, wherein the plate heat exchanger (1, 1') is connected to a bioreactor (27, 27').

13. The plate heat exchanger of claim 12, wherein for the exhaust gas cooling of a gas to be evacuated from the bioreactor (27'), the port (23') for the entry of the second fluid is connected to an exhaust gas line (29) of the bioreactor (27') and the port (24') for the exit of the second fluid is connected to an inlet of a sterile filter (30), and the ports (21', 22') for the first fluid are connected to a cooling circuit.

14. The plate heat exchanger of claim 13, wherein the condensate port (26) is connected to an inflow port of the bioreactor (27') at location spaced from the exhaust gas line (29) of the bioreactor (27').

15. The plate heat exchanger of claim 12, wherein for the preheating of a medium which is to be fed to the bioreactor (27), the port (23) for the entry of the second fluid is connected to a medium supply line (31) for supplying the medium and the port (24) for the exit of the second fluid is connected to an inflow port of the bioreactor (27), and the ports (21, 22) for the first fluid are connected to a temperature control circuit.

16. The plate heat exchanger according to claim 1, wherein the plate heat exchanger (1, 1') is a disposable.

17. A plate heat exchanger, comprising:

a plurality of substantially identical plates (40', 50') formed from plastic, each of the plates (40', 50') having opposite first and second surfaces, the first surface of each of the plates (40', 50') having a first depression defining a first flow channel (4') for a first fluid and a first inlet (9') and a first outlet (8') extending through the plate (40', 50') at the first depression, first flow guides (12) formed in the first depression and extending in a first direction, the second surface of each of the plates (40', 50') having a second depression defining a second flow channel (5') for a second fluid with a second inlet (14') and a second outlet (13') extending through the plate (40', 50') at the second depression, second flow guides (16) formed in the second depression and extending in a second direction that is different from the first direction, the first and second flow depressions being mirror-symmetrical with one another, the plates being bonded or welded in direct surface-to-surface contact with one another and oriented so that at least one of the first flow channels in each of the plates registers one of the flow channels in at least one of the plates adjacent thereto with fluid tight seals of the registered flow channels, the plates further being configured so that the first inlet (9') and the first outlet (8') do not register with the second flow channel (5') and so that the second inlet (14') and the second outlet (13') do not register with the first flow channel (4'), the plates stacked between a front plate (6, 6') and an end plate (7, 7'), wherein the front plate (6, 6') has two first ports (21, 21', 22, 22', 23, 23', 24, 24') for the first fluid and two second ports (23, 23', 24, 24') for the second fluid, the second flow channel (5'), in a lower region in a vertical direction, having a collecting space (25) to receive condensate of the second fluid that can be evacuated via a condensate port (26) spaced from the second ports (23, 23', 24, 24'), wherein the collecting space (25) is connected with the second outlet (13') to define an elongated through opening having in the vertical direction a lower region aligned with the condensate port (26) and an upper region aligned with one of the second ports (23, 23', 24, 24').

* * * * *